US005244045A

United States Patent [19]

Mota

[11] Patent Number: 5,244,045

[45] Date of Patent: Sep. 14, 1993

[54] TOOL FOR SIMULTANEOUS VERTICAL CONNECTIONS

[75] Inventor: Juvenal D. S. Mota, Rio de Janeiro, Brazil

[73] Assignee: Petroleo Brasileiro S.A. - Petrobras, Rio de Janeiro, Brazil

[21] Appl. No.: 775,443

[22] Filed: Oct. 15, 1991

[30] Foreign Application Priority Data

Oct. 12, 1990 [BR] Brazil ..... 9005131

[51] Int. Cl.[5] ..... E21B 43/01

[52] U.S. Cl. ..... 166/341; 166/344; 166/347; 285/24

[58] Field of Search ..... 166/341, 342, 75.1, 166/356, 347

[56] References Cited

U.S. PATENT DOCUMENTS

| | | | |
|---|---|---|---|
| 3,721,294 | 3/1973 | Nelson | 166/342 |
| 3,722,585 | 3/1973 | Nelson et al. | 166/341 |
| 3,775,986 | 12/1973 | Daughtry | 166/343 X |
| 3,817,281 | 6/1974 | Lewis et al. | 166/341 |
| 4,188,050 | 2/1980 | Lochte | 166/341 |
| 4,671,702 | 6/1987 | Langner | 166/342 X |
| 4,974,996 | 12/1990 | Vielmo et al. | 166/341 |

*Primary Examiner*—Ramon S. Britts
*Assistant Examiner*—Frank S. Tsay
*Attorney, Agent, or Firm*—Sughrue, Mion, Zinn, Macpeak & Seas

[57] ABSTRACT

A universal tool for simultaneous vertical connections (10) between two flow line terminals (12) and (13) to be connected, includes two vertical hydraulic connectors (14, 15) for locking to fishing mandrels (16, 17) of the bridge of connections (11). A telescopic system (18, 19) allows for the adjustment of the spacing between the connectors. A vertical movement system allows for the elevation of the second connector (15) in relation to the first connector (14) to render easy the fitting of the bridge (11) and provide compensation for vertical deviations between the flow line terminals (12, 13) to be connected. A spherical coupling system (21) set in a split housing of spherical internal sections (22, 23) allows for compensation of angular deviations. A spacing (24) and a set of spring (25) allows for compensation of horizontal deviations between those terminals (12, 13). A slot key (26) in the first connector (14) and a funnel (27) around the first fishing mandrel (16) allow for the orientation of the tool (10) during reentry operation in the bridge of connectors (11).

9 Claims, 4 Drawing Sheets 15
18
19
20
10
32
31
33
30
34
43
44
14
26

TOOL FOR SIMULTANEOUS VERTICAL CONNECTIONS

FIELD OF THE INVENTION

This invention refers to a universal tool for simultaneous vertical connections, the main purpose of which is to locate in one single instrument of easy handling, operationality and susceptible of maintenance, the whole active system involved, which, by means of appropriate mechanisms, correctly positions a bridge of connectors on two flow line terminals pertaining to equipment units to be connected.

BACKGROUND OF THE INVENTION

In subsea completion systems, the utilization of which is increasing, becoming more complex with their orientation towards deep waters, becomes vital, as a major step towards the development and improvement of those systems, the necessity of a remote connection system which does not sophisticate the most complex equipment units in the system, and which provides also a method of maintenance and adjustment in the connection system without the necessity of handling those complex equipment units.

SUMMARY OF THE INVENTION

With the purpose of complying with what has been exposed above, this invention provides a tool for simultaneous vertical connections utilized in a system which introduces a concept of subsea remote connection between two terminal mandrels of flow lines which, since they are located in different structures (or equipment units), present deviations due to tolerances (manufacturing, erection, installation), in which it becomes necessary that the tool which performs this connection be provided with systems which render it compatible with those deviations. The connection between the flow line terminals being carried out through a module (bridge) containing two hydraulic connectors united by a bridge of flexible or articulated lines which absorb the imposed movements which may become necessary.

The tool activates, with the mechanisms required (hydraulic and mechanical) for the correction of the deviations (vertical-horizontal-angular), which make possible to fit the module of connectors, is also possible to recover the same for eventual maintenance, thus rendering recoverable all the active elements of the system, allowing for a larger flexibility in the use of the equipment and a rather significant simplification of the problem of tolerances.

An advantage offered is to prevent the interruption of a well's operation for purposes of maintenance in some equipment from interfering with the production of the other wells, since the concept herein presented implies a modularization per well.

Another advantage is to transfer to the tool of installation of the intervention connectors, the whole active system required for the compensation of the deviations, avoiding the utilization of very strict tolerances in the manufacturing and erection of the equipment units which affect directly or indirectly the final positioning of the flow line terminals, since the whole system required for the correction of misalignments is located in the tool, being susceptible of being maintained and adjusted.

Another advantage is the simplification in the operation of the more complex equipment units (WCT-Manifold) and reduction in the possibility of failure of same during the operation, since the same do not any longer have the active connection of the system, transferring the possibility of failure in the connection, from the complex equipment units to the bridge of connectors. This reduces the possibilities of failure in the maintenance of those equipment units mentioned, since those equipment units (WCT-Tree Module-Manifold) shall have a lower number of seals and a smaller number of simultaneous connections, since the same are distributed in the bridges of connectors (one per well), not existing anylonger, in addition, any flexible or articulated pipelines located in those equipment units. The handling of those equipment units shall be avoided as much as possible since it sometimes becomes complex and time-consuming, as follows: WCT (requiring well killing, safety plug installation, etc.), the Manifold (requiring the production paralyzation of other wells until reconnection is made).

Still another advantage is the standardization of one single tool to make connections between terminals containing any arrangement of flow lines, said standardization allowing the tool to be utilized with any arrangement of flow lines pertaining to any equipment units (WCT-Tree Module-Manifold-Export Line Connectors) which are to be connected.

It is, thus, an object of this invention to provide a universal tool for simultaneous vertical connections which, through mechanisms, correctly positions a bridge of connectors on two terminals of flow lines pertaining to equipment units to be connected. The tool includes two vertical hydraulic connectors for locking to the fishing mandrels of the bridge of connectors, a telescopic system allowing for the adjustment of the spacing between the connectors, a vertical movement system allowing for the elevation of the second connector in relation to the first connector to make easy the fitting of the bridge and the compensation for vertical deviations between the flow line terminals to be connected, a spherical coupling system set in split housings of spherical internal sections allowing for the compensation for angular deviations. The spacing and set of springs allow for compensation for horizontal deviations between those terminals and a slot key in the first connector and a funnel around the first fishing mandrel allow for the orientation of the tool in operation of re-entry at the bridge of connectors. It is still an object of this invention a bridge of two vertical connectors, united by flexible or articulated pipelines, the arrangement of those lines being in accordance with what is to be connected, whether flow lines only (production-annulus-injection), or flow lines and hydraulic umbilical (for control) and electric cable (for the monitoring of some equipment unit), in any desired arrangement.

BRIEF DESCRIPTION OF THE DRAWINGS

The invention shall be hereafter described in more detail together with the drawings which accompany this specification, in which.

DESCRIPTION OF THE PREFERRED EMBODIMENTS

Figure 1:
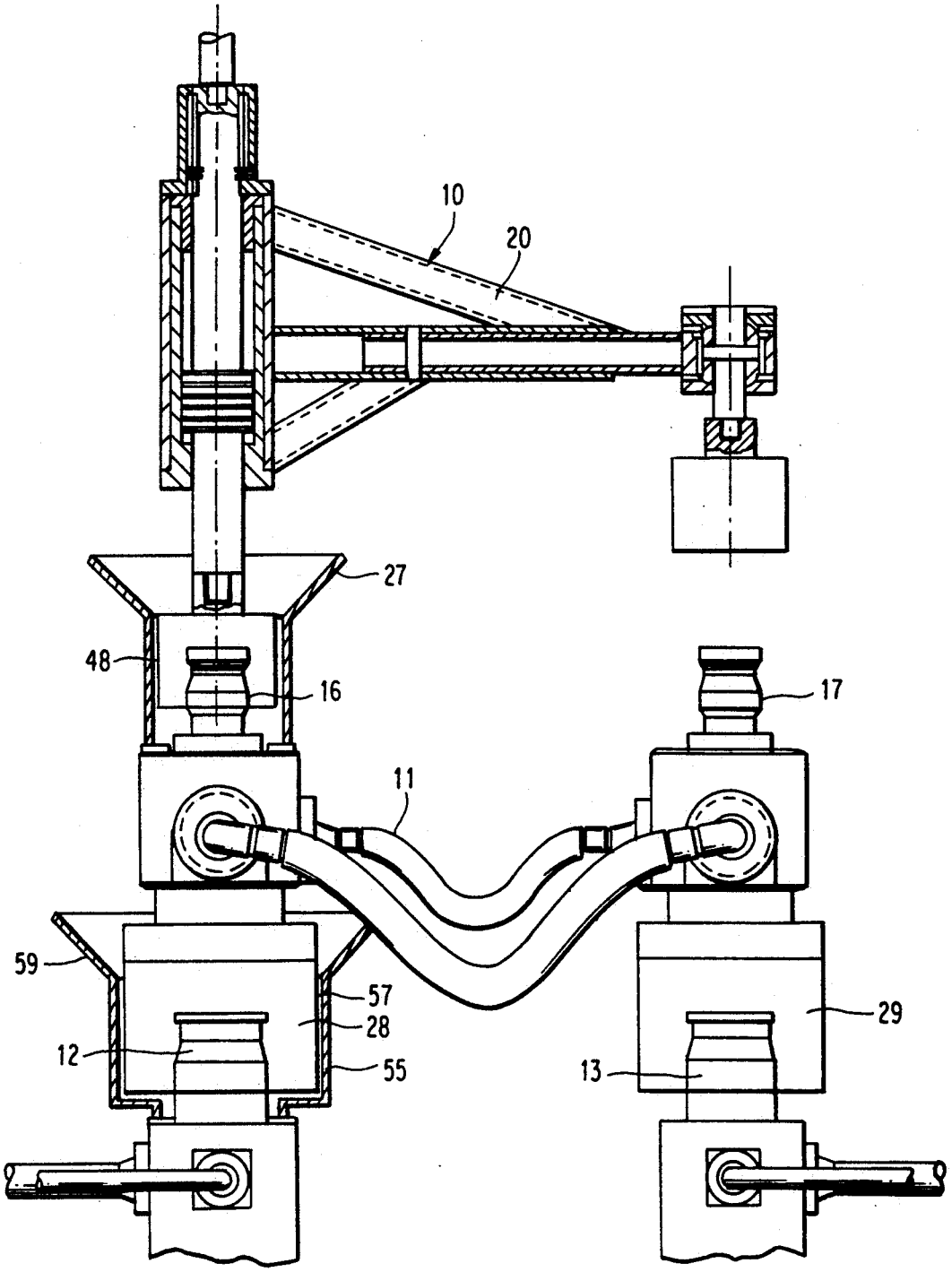
FIG. 1 is a section view of the tool for simultaneous vertical connections installed on a bridge of connectors which contains the flow line jumper necessary for the connection between two flow line terminals.
Figures 2, 3, 4:
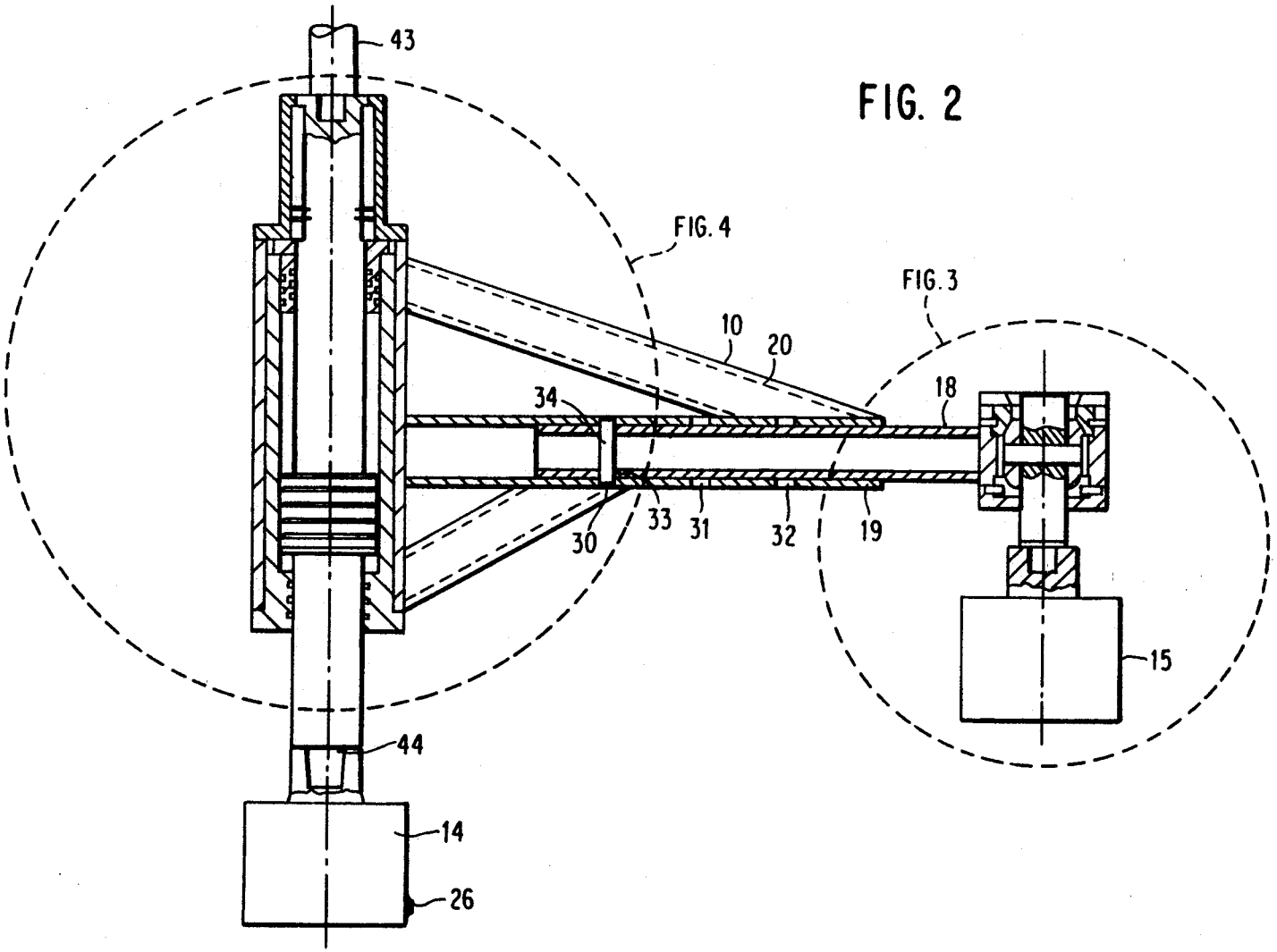
FIG. 2 is a section view of the tool.
FIG. 3 is an enlarged section view, taken from FIG. 1, of the angular and horizontal compensation system of the connection tool.
FIG. 4 is an enlarged section view, taken from FIG. 1, of the vertical compensation system of the connection tool.
Figure 3:
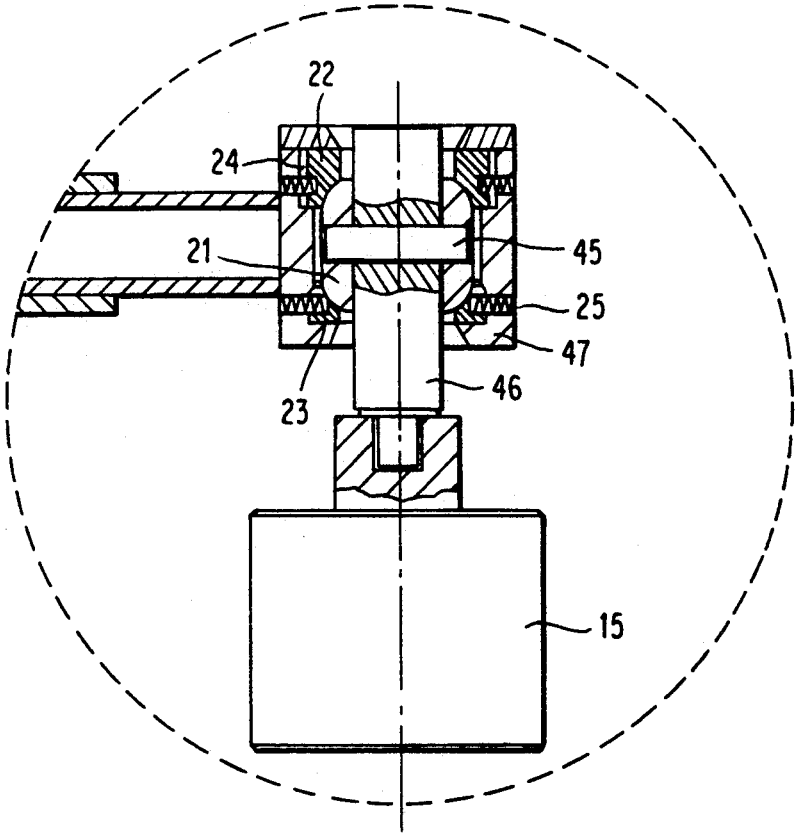
Figure 4:
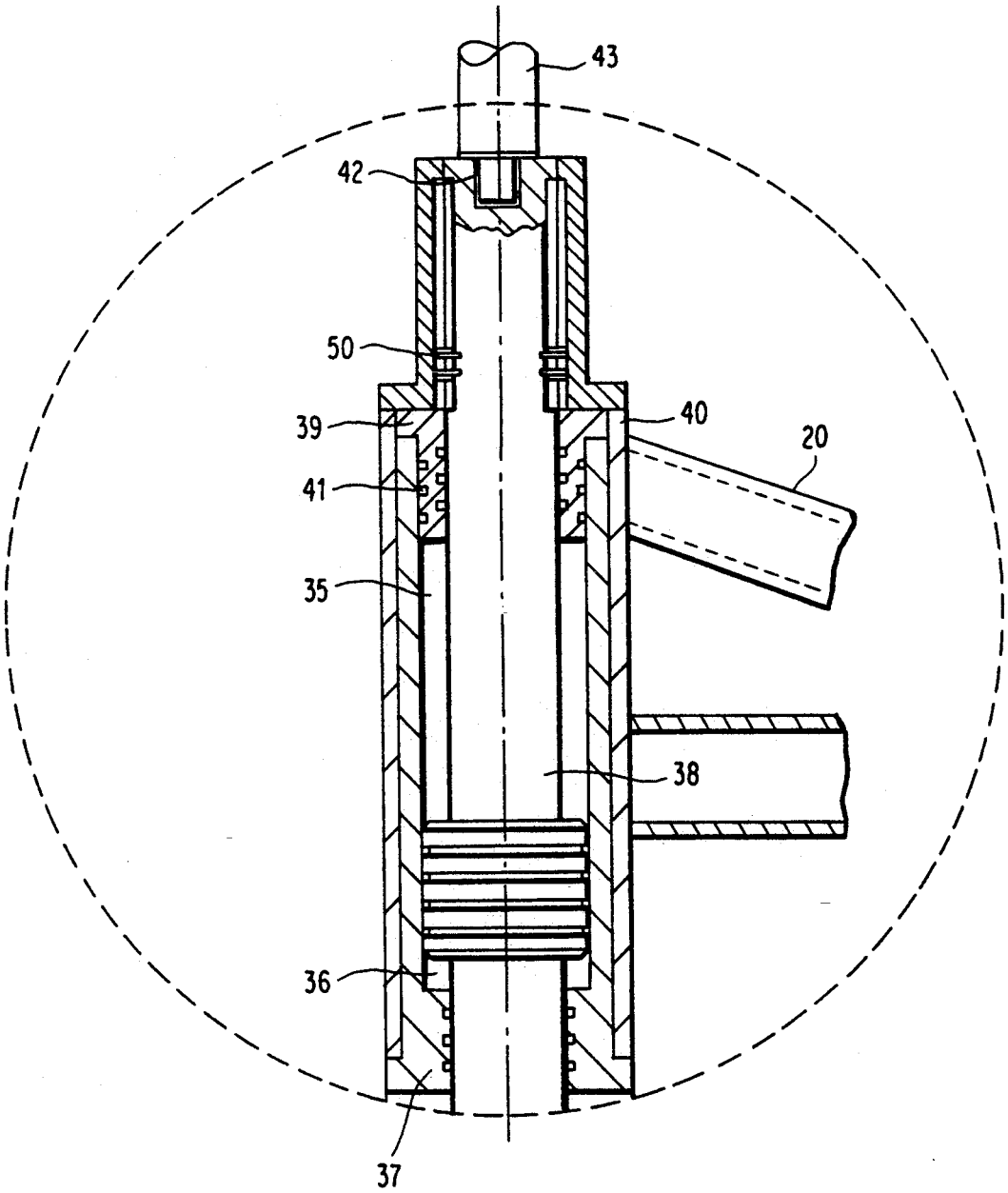

As it can be inferred from the Figures, the universal tool for simultaneous vertical connections, designated in general by numerical reference 10, utilized for installation of a bridge of connectors 11 containing a jumper of flexible lines (flow lines-hydraulic umbilical-electric cable, in any desired arrangement), which shall make the connection between two flow line terminals 12, 13, includes two vertical hydraulic connectors 14, 15 for locking to the fishing mandrels 16, 17 of the bridge of connectors 11, a telescopic adjustment system allowing for the adjustment of the spacing between the connectors 14, 15 through two relatively movable coaxial arms 18, 19, FIG. 2. Arm 18 is mounted for horizontal telescoping movement movement, internally of arm 19. A vertical compensation system with upwards and downwards movement of the structure 20 which supports the second connector 15 in relation to the first connector 14 makes it easy to fit the bridge 11 and the compensation of vertical deviations between the flow line terminals to be connected. An angular compensation system is utilized in the second connector 15 by means of a spherical-shaped articulation body 21 set in a split housing defined by spherical internal sections 22, 23 allowing for the compensation for angular deviations. The spacing or play 24, and a set of springs 25 allows for the compensation for horizontal deviations between those terminals and the split housing. An orientation system with a slot key 26 in the first connector 14 and a funnel 27 around the first fishing mandrel 16, allows for the orientation of the tool 10 during re-entry in the bridge of connectors 11.

First, connection is made of one of the connectors of the bridge 28, in the first flow line terminal 12, where the correct positioning and necessary load is achieved through the movement of the operation column 43, the second connector of the bridge 29 being out of position at that time. The correct positioning of the second connector is achieved through a spherical articulation system, supported by a set of springs 25 allowing for angular and lateral (offset) compensation in relation to the first flow line terminal 12, whereas the vertical approach and necessary load for the connection is achieved by means of a hydraulic system located in the body of the tool 10.

In the telescopic adjustment system, FIG. 2, through two arms 18, 19 the adjustment of arm 18 is achieved by means of the holes 30, 31, 32 located in the external arm 19, and of the hole 33 located in the internal arm 18. The position selected is maintained through the attachment pin 34, fitted into aligned holes, i.e. 30 and 33; 31 and 33, etc., and as many positions as desired may be utilized by the system, not only three as herein indicated.

In the vertical compensation system, the upwards movement is achieved through the application of pressure to chamber 35, FIG. 5, and the downwards movement is achieved through the application of pressure to the chamber 36. The up and down movement of the structure 20 is achieved through the components 37, 39, 40 which are the moving components driven by means of pressure. A central component 38 forms the rigid element of the system so that the components 37, 39, 40 may move relative to component 38. Dynamic sealing rings 41 provide the sealing required for the hydraulic pressure to act in the chambers 35, 36. The central component 38 is also provided in its upper extremity with a female thread 42 compatible with the operation column 43 of the equipment, and in its lower extremity with a male thread 44, FIG. 2, for connection with the upper extremity of the first connector 14. Two slot keys 50 maintain the positioning of the tool 10 attached to the operation column 43.

In the angular compensation system utilized in the second connector 15, the spherical-shaped articulation body 21 supports, through the pin 45, the supporting shaft 46 of the second connector 15, the articulation body 21 working induced by accommodation movements between the second bridge connector of the bridge 29 of connectors and the second flow line terminal 13, sliding on the shperical-shaped housing sections 22, 23.

The horizontal compensation system for the second connector 15 operates through a system of stops 47 and the play 24 existing between the internal face of those stops and the external face of the spherical housings 22 and 23. The horizontal movement is induced by accommodation movements between the second bridge connector 29 of connectors and the second flow line terminal 13, whereas a set of springs 25 maintains the supporting shaft 46 in the vertical position when the angular compensation system is not being utilized.

The orientation system employs a slot key 26 guided through a helical slot 48 located internally to the funnel 27, with the opening of the funnel 27 turned upwards, installed concentrically around the fishing mandrel 16 in the upper portion of the first bridge connector 28.

It must be pointed out that the tool for simultaneous vertical connections 10, the object of this invention, can be utilized for connection between any flow line arrangements, being therefor provided with a mechanically (or hydraulically) adjusted telescopic system, providing the bridge connectors with the spacing required for the lines to be connected.

Further, in relation to the orientation system, a slot key 55 of the first connector 28 is guided through a helical slot 57 located internally to the funnel 59, for facilitating the system installation operation.

I claim:

1. In a tool for simultaneous vertical connections utilized for installation of a bridge of connectors (11) containing a jumper of flexible lines interconnecting first and second fishing mandrels (16, 17), and wherein said tool achieves a connection between two flow line terminals (12, 13) and first and second vertical hydraulic connectors (14, 15) of said tool for locking said fishing mandrels (16, 17) of the bridge of connectors (11), the improvement wherein said tool further comprises:

a telescopic adjustment system allowing adjustment of a horizontal spacing between said vertical hydraulic connectors (14, 15), said adjustment system comprising a set of telescoping arms (18, 19);

a vertical compensation system including an upwards and downwards movable structure (20) supporting said second vertical hydraulic connector (15) relative to said first vertical hydraulic connector (14);

an angular compensation system of said second vertical hydraulic connector (15) comprising an interior spherical-shaped articulation body (21) fixed to a supporting shaft mounting said second vertical hydraulic connector, said spherical-shaped articulation body (21) being set in a housing in contact with a plurality of spherical internal sections (22, 23) mounted to one end of one of said set of telescoping arms;

a set of springs (25) interposed between said spherical internal sections and said housing for compensation for horizontal deviations between the flow line terminals (12, 13); and an orientation system including a slot key (26) in said first vertical connector (14) and a funnel (27) concentrically around said first fishing mandrel (16) allowing for variation in orientation of the tool (10) during re-entry thereof in said bridge of connectors (11).

2. Tool for simultaneous vertical connections according to claim 1, wherein said telescopic adjustment system comprises means for adjustable positioning of said arm (18) horizontally interiorly within said arm (19), the adjustable positioning means comprising longitudinally spaced holes (30, 31, 32) located in said external arm (19), a hole (33) located in said internal arm (18) and an attachment pin (34) selectively positioned within one of said longitudinally spaced holes in said external arm and said hole in said internal arm.

3. Tool for simultaneous vertical connections according to claim 1, wherein said vertical compensation system further comprises an upper chamber (35) and a lower chamber (36), and means for applying hydraulic pressure to said upper chamber (35) to effect upwards movement of said structure (20) and for applying hydraulic pressure to said lower chamber (36) to effect downwards movement of said structure (20).

4. Tool for simultaneous vertical connections according to claim 3, wherein the upwards movement of said structure (20) is effected by means of movable components (37, 39, 40) driven by hydraulic pressure, and the tool includes a central component (38) in the form of a rigid element of said system to facilitate the movement of the movable components (37, 39, 40).

5. Tool for simultaneous vertical connections according to claim 1, wherein said angular compensation system further comprises a pin (45) coupling said spherical shaped articulation body (21) to a supporting shaft (46) fixed to said second vertical hydraulic connector (15) and said angular compensation system accommodates movements between the second bridge connector (29) and the second flow line terminal (13) by sliding of the spherical-shaped articulation body on the spherical-shaped internal sections (22, 23) of said split housing.

6. Tool for simultaneous vertical connections according to claim 1, wherein the horizontal compensation system of said second vertical hydraulic connector (15) comprises a plurality of stops (47) within said housing and abutting external faces of said housing spherical sections (22, 23).

7. Tool for simultaneous vertical connections according to claim 1, wherein said orientation system includes a slot key (26) guided through a helical slot (48) located internally of said funnel (27), and said funnel has an opening turned upwards and is installed concentrically around said fishing mandrel (16) in an upper portion of the first bridge connector (28).

8. Tool for simultaneous vertical connections according to claim 1, wherein said orientation system includes a slot key (55) in said first bridge connector (28) guided through a helical slot (57) located internally of the funnel (59), thereby facilitating orientation of the first bridge connector (28) relative to said funnel (59) during system installation operation.

9. Tool for simultaneous vertical connections according to claim 1, wherein said bridge of connectors (11) contains said two vertical hydraulic connectors (28) and (29), and flow control lines uniting said two flow line terminals.

* * * * *